US005884456A

United States Patent [19]

Hansen

[11] Patent Number: 5,884,456

[45] Date of Patent: Mar. 23, 1999

[54] METHOD AND APPARATUS FOR PACKAGING ARTICLES

[75] Inventor: Roger P. Hansen, Rockford, Mich.

[73] Assignee: Display Pack, Inc., Grand Rapids, Mich.

[21] Appl. No.: 964,493

[22] Filed: Nov. 5, 1997

[51] Int. Cl.[6] ..... B65B 5/00; B65B 7/00

[52] U.S. Cl. ..... 53/467; 53/390; 53/476; 53/477; 206/461; 206/462

[58] Field of Search ..... 206/461, 462; 53/467, 453, 476, 477, 390, 559

[56] References Cited

U.S. PATENT DOCUMENTS

| | | | |
|---|---|---|---|
| 3,406,492 | 10/1968 | Ludwig | 53/453 |
| 3,657,857 | 4/1972 | De Woskin et al. | 53/453 |
| 3,889,452 | 6/1975 | Loeffler et al. | 53/390 |
| 3,997,052 | 12/1976 | Eddy et al. | 53/453 |
| 4,322,930 | 4/1982 | Braverman | 53/390 |
| 4,848,066 | 7/1989 | Luhman | 53/390 |
| 4,867,304 | 9/1989 | Garcia | 206/461 |
| 5,603,201 | 2/1997 | LaFata et al. | 53/453 |
| 5,613,349 | 3/1997 | Brown | 53/453 |

*Primary Examiner*—James F. Coan
*Assistant Examiner*—Gene L. Kim
*Attorney, Agent, or Firm*—Warner Norcross & Judd

[57] ABSTRACT

A method and apparatus for assembling a blister package. The apparatus includes a packaging jig having a plurality of perimeter locating pins that are arranged to extend around the perimeter of the package when assembled on the jig. In a first aspect, the jig also includes an interior locating pin positioned inwardly from the perimeter locating pins to register a blister and possibly an article during assembly. In a second aspect of the invention, the jig further includes a plurality of exterior locating pins positioned outwardly from the perimeter locating pins to register an article to be packaged during assembly. The blister package is assembled by sequentially positioning the display cards, blister, and article on the jig such that the locating pins register the various components. The display cards are positioned within the perimeter locating pins, the blister is positioned between the perimeter locating pins and the interior locating pin, and the article is positioned between the interior locating pin and the exterior locating pins. Once positioned on the jig, the components are interconnected using conventional methods and apparatus.

29 Claims, 5 Drawing Sheets

METHOD AND APPARATUS FOR PACKAGING ARTICLES

BACKGROUND OF THE INVENTION

The present invention is directed to a method and apparatus for packaging, and more particularly to a packaging jig and method for packaging articles utilizing the jig.

Blister packages are commonly used in industry to package and display a wide variety of articles. Blister packages typically include a transparent or translucent blister that is secured to one or more display cards. The blister generally includes a pocket that holds the packaged article(s) and a flange used to secure the blister to the display card(s). Typically, a blister package is assembled by either securing the flange of the blister directly to the surface of a single display card or by sandwiching the flange between a pair of display cards. The display cards cooperate with the blister to entrap the article and provide a surface to display graphics, advertising material, and product information.

In assembling a blister package, it is important to properly locate the blister with respect to the display card(s). In many applications, the package is assembled using a packaging jig which functions to align and hold the components of the package. In such applications, the jig typically includes locating pins that hold the display cards in place as well as a nest that receives the pocket of the blister. Further, an opening is defined in one of the display card(s). This opening is positioned to align with the nest during assembly. The blister is registered by placing it on the display card with its pocket extending down through the card opening into the nest in the jig. The blister flange engages the card around the card opening to support the blister. Alternatively, the blister can be located manually (by hand). While these methods are adequate in many instances, they both suffer from a number of disadvantages. The use of an opening in the display card in combination with a conventional jig restricts placement of the blister because, to be adequately held in place, the blister must be entrapped from all sides by the card. If not, the blister is free to shift with respect to the display card. This problem makes it particularly difficult to assemble a package in which the blister extends up to or beyond an outer edge of the card. Further, this method is not reliable when the blister is a flat film or if the pocket is relatively shallow because the blister easily moves or shifts out of the card opening and the jig nest during assembly. On the other hand, manually locating the blister is labor intensive and significantly increases the manufacturing cost of the package. Another significant problem associated with the use of a conventional shallow blister is that the blister will occasionally be flipped during assembly so that the pocket opens downwardly instead of upwardly. Obviously, this prevents the article from being dropped into the pocket of the blister.

It is also important to properly locate the article within the blister during assembly. In conventional applications, the orientation of the article within the package is determined by the shape and contour of the article and the blister pocket. Typically, the contours of the blister pocket and the article will interlock to hold the article in place within the package. In some applications, however, the article and the blister pocket will not have significant enough contours and/or depth to hold the article in place. For example, many phone card packages include a blister that is generally planar and relatively shallow (i.e. approximately equal to the thickness of the phone card). As a result, the phone card is easily bumped or shifted out of the blister pocket during assembly. This increases the possibility that the phone card will be misaligned during assembly.

In some applications, the blister may be cut to provide an opening which permits the article to protrude from the blister. Returning to our previous example, many phone cards are packaged behind an "open" blister having an open side located at the bottom edge of the display cards. The opening in the blister permits the bottom edge of the phone card to extend from the package so that the magnetic strip is accessible for reading without opening the packaging. Because of the open edge and the simple planar shape of the phone card, the phone card is free to slide or shift out of the open end of the blister during assembly. This also increases the possibility that the phone card will be misaligned during assembly.

SUMMARY OF THE INVENTION

The aforementioned problems are overcome by the present invention wherein a jig is provided with locating pins for registering the display cards, the article to be packaged, and the blister. The blister is preferably a transparent, planar film which covers the article. Alternatively, the blister can include a pocket for receiving the article. The locating pins function to register various elements of the package during assembly. The jig also includes an interior locating pin spaced inwardly from the perimeter locating pins in correspondence with the inner edge of the blister or with a locating notch defined in the blister. The interior locating pin prevents the blister and phone card from shifting inwardly during assembly. The jig further includes at least one external locating pin that is spaced outwardly from the perimeter locating pins to prevent the article from shifting outwardly during assembly.

The present invention also provides a method for packaging articles using the jig. The method includes the steps of (1) placing a front display card defining an aperture onto the jig with its outer edge abutting the perimeter locating pins and its aperture fitted over the interior locating pin, (2) placing a blister onto the jig over the front display card with one edge abutting the interior locating pin and another edge abutting at least one perimeter locating pin, (3) placing an article onto the jig over the blister, (4) placing a rear display card defining an aperture onto the jig over the blister with its outer edge abutting the perimeter locating pins and its aperture fitted over the interior locating pin, and (5) intersecuring the blister and the front and rear display cards. In the most preferred embodiment, the method further includes the additional steps of providing the jig with an external locating pin and placing the article onto the jig with at least one edge of the article abutting the external locating pin.

The present invention provides a simple and effective method and apparatus for assembling a package with a transparent film or blister. The interior locating pin prevents the blister and the article from shifting inwardly during assembly. Also, the exterior locating pin prevents the article from shifting outwardly during assembly. Further, because the locating pins locate the various elements of the package, a pocket is not necessary to locate the blister and the article. As a result, the package can include a planar blister rather than a conventional pocketed blister. This eliminates the need to preform the blister, thereby decreasing the cost of the package. Also, because the blister is planar, it can be flipped during assembly without affecting the package.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
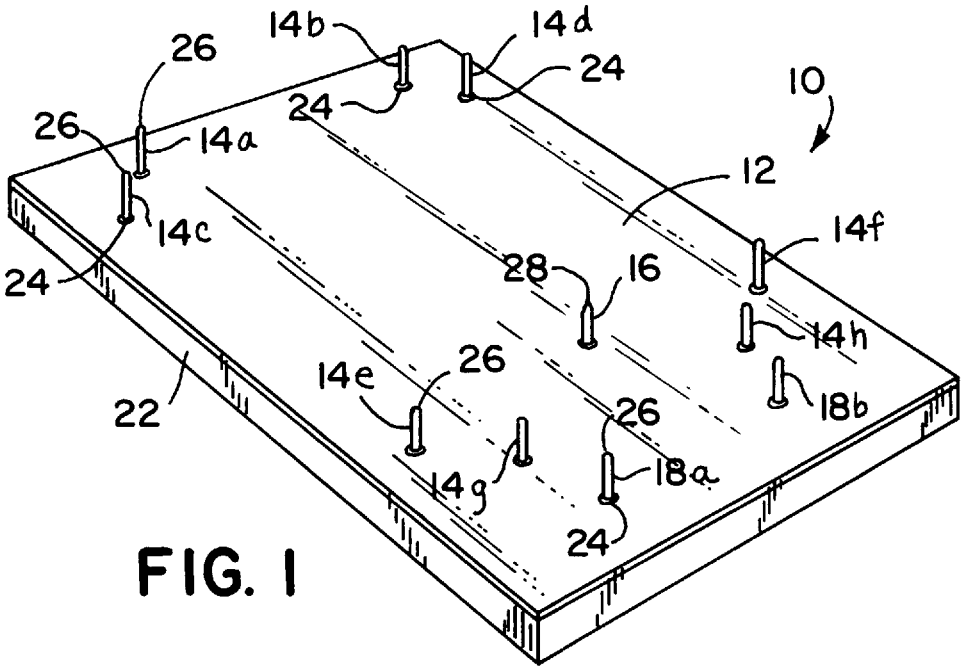
FIG. 1 is a perspective view of a packaging jig according to the present invention.
Figure 12:
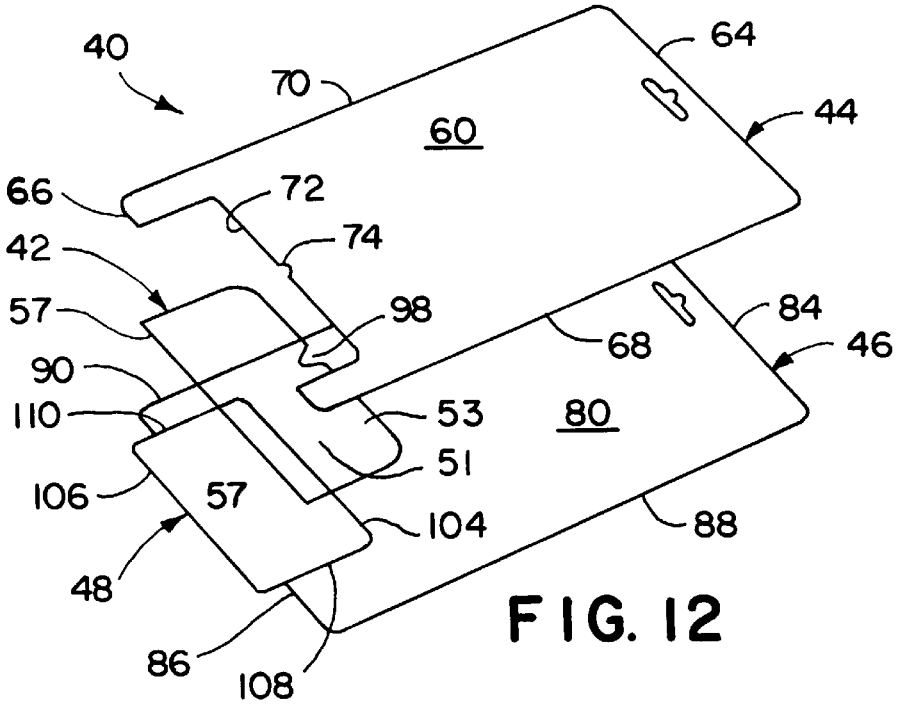
FIG. 12 is an exploded view of the package.

A packaging jig according to a preferred embodiment of the present invention is illustrated in FIG. 1 and generally designated 10. The present invention is described in connection with the assembly of a generally conventional phone card package 40. As perhaps best shown in FIG. 12, the phone card package 40 includes a phone card 48 and a transparent, planar blister 42 located between front 44 and rear 46 display cards. The bottom edge 106 of the phone card 48 protrudes beyond the display cards 44, 46 and the blister 42 so that it can be passed through a card reader (not shown) without removing it from the package 40. Alternatively, the bottom edge 106 of the phone card 48 can be flush with the bottom edge of the display cards 44, 46 and the blister 42. While the present invention is described in connection with a phone card package, it is also well suited for use in connection with other display packages that include a blister, an article, or other element that extends inwardly or outwardly from the perimeter of the display card. For example, the present invention is easily adapted for use with a package having only a single display card and/or multiple blisters. Also, the present invention is well suited for use with both planar and pocketed blisters.

As described in more detail below, the packaging jig 10 includes a work surface 22, a platen 12 covering the work surface 22, and a plurality of locating pins 14*a–h*, 16, and 18*a–b* which cooperate to register the display cards 44 and 46, the blister 42, and the phone card 48. The phone card package 40 is assembled by sequentially placing the front display card 44, the blister 42, the phone card 48, and the rear display card 46 onto the jig 10. The various components are intersecured using conventional methods. In the most preferred embodiment, the phone card 48 is secured to the rear display card 46 by a conventional peelable adhesive and the display cards 44 and 46 and blister 42 are intersecured by a heat activated adhesive. The heat activated adhesive is activated by a conventional heat press (not shown) after all of the components of the package 40 are placed onto the jig 10.

Figure 2:
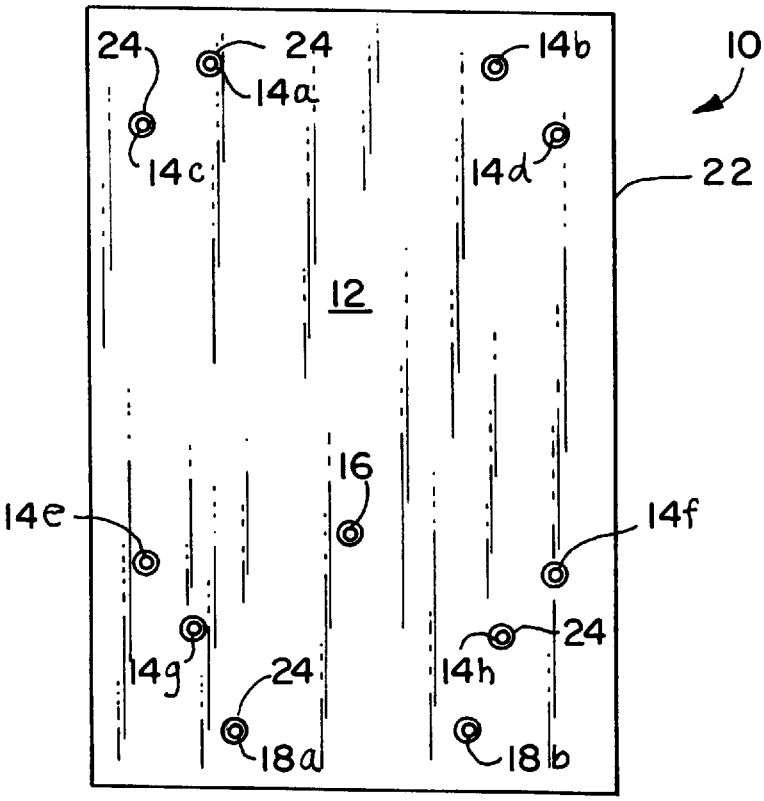
FIG. 2 is a top plan view of the jig.

Referring now to FIG. 2, the work surface 22 is a planar, generally rectangular surface. The work surface 22 is covered with a platen 12 which facilitates package assembly by helping to provide uniform pressure over the package 40 when the press (not shown) is applied. The platen 12 is attached to the jig 10 by conventional methods such as fasteners or adhesive. The platen 12 is preferably manufactured from conventional platen materials such as silicone rubber or cork. In applications where the planar blister 42 is replaced by a pocketed blister, the platen 12 can be die cut or otherwise relieved to define an opening which receives the pocket and, if necessary, the article. If the pocket is deeper than the thickness of the platen 12, the work surface 22 can also be cut to define a void which receives the pocket and, if necessary, the article. If desired, the platen 12 can be eliminated. If such cases, the work surface 22 will preferably be manufactured from aluminum or wood.

Figure 3:
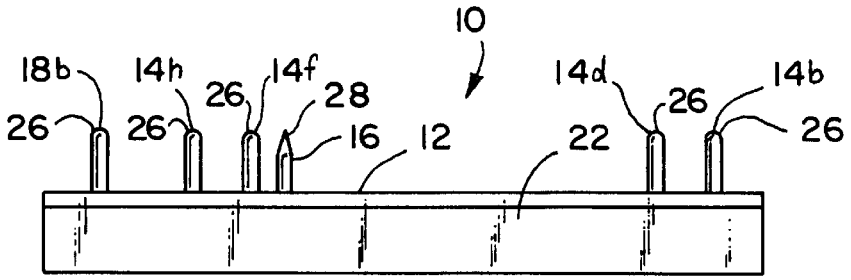
FIG. 3 is a side elevational view of the jig.

The packaging jig 10 includes a plurality of perimeter locating pins 14*a–h*, a single interior locating pin 16, and a pair of exterior locating pins 18*a–b*. The number and location of the perimeter, interior, and exterior locating pins will vary from application to application. For example, in some applications it may be desired to include multiple interior locating pins and/or a single exterior locating pin. The locating pins 14*a–h*, 16, and 18*a–b* are generally conventional solid or spring loaded pins that are installed in the jig 10 using conventional techniques and apparatus. For example, the locating pins 14*a–h*, 16, and 18*a–b* can be adhesively or frictionally secured within mounting bores 24 defined in the jig work surface 22. Alternatively, the pins 14*a–h*, 16, and 18*a–b* can include a threaded shaft (not shown) and can be secured to the work surface 22 by mounting nuts (not shown). As perhaps best illustrated in FIG. 3, the perimeter 14*a–h* and exterior 18*a–b* locating pins each include a rounded tip 26, and the interior locating pin 16 includes a conical tip 28. The rounded 26 and conical 28 tips facilitate package assembly by shepherding slightly askewed components into proper registration. Alternatively, the tip of pin 16 can be rounded or squared. However, the conical tip 28 provides for maximum shepherding. In some applications, it may also be desirable to replace some or all of the locating pins with blocks, sponges, stops or other locating elements.

The perimeter locating pins 14*a–h* are arranged to correspond with the perimeter of the blister package 40 when it is assembled on the jig 10. As perhaps best illustrated in FIG. 10, locating pins 14*a* and 14*b* are positioned to abut the top edge of the package 40, locating pins 14*c–f* are positioned to engage opposed side edges of the package 40, and locating pins 14*g* and 14*h* are positioned to engage the bottom edge of the package 40, the bottom edge of the blister 42, and opposed side edges of the phone card 48. The interior locating pin 16 is positioned inwardly from the perimeter locating pins 14*a–h* to engage the inner edge of the blister 42 and the inner edge of the phone card 48 to prevent them from shifting inwardly during assembly. The exterior locating pins 18*a* and 18*b* are positioned outwardly from the perimeter locating pins 14*a–h* to engage the outer edge of the phone card 48 to prevent it from twisting or shifting outwardly during assembly. The described embodiment is designed for use with a conventional rectangular phone card package in which the phone card protrudes beyond or is flush with the bottom of the display cards. One of ordinary skill in the art will appreciate and understand that the number and arrangement of locating pins will vary from application to application depending on the design of the package.

Manufacture and Assembly of the Package

Figure 4:
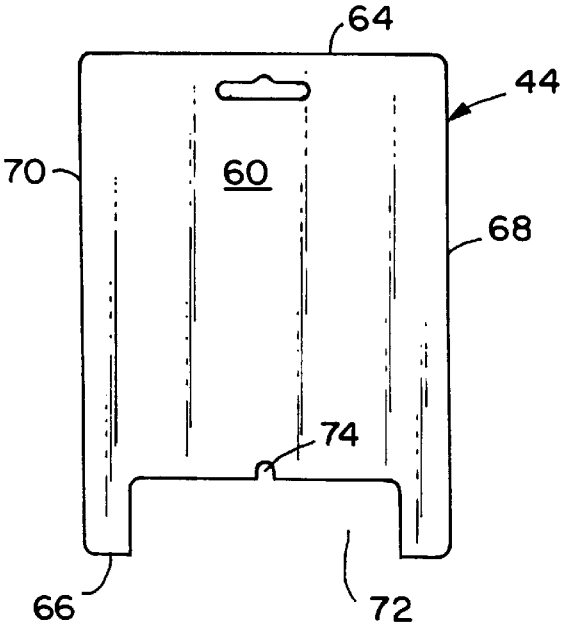
FIG. 4 is a top plan view of the front display card.
Figure 6:
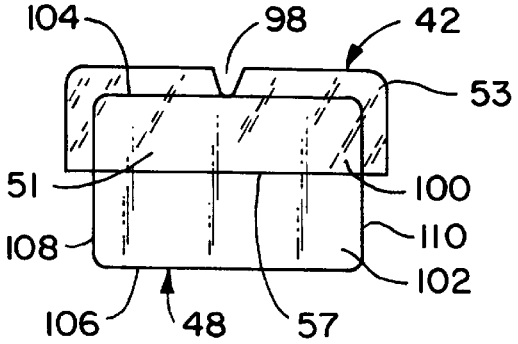
FIG. 6 is a top plan view of the phone card and blister.
Figure 7:
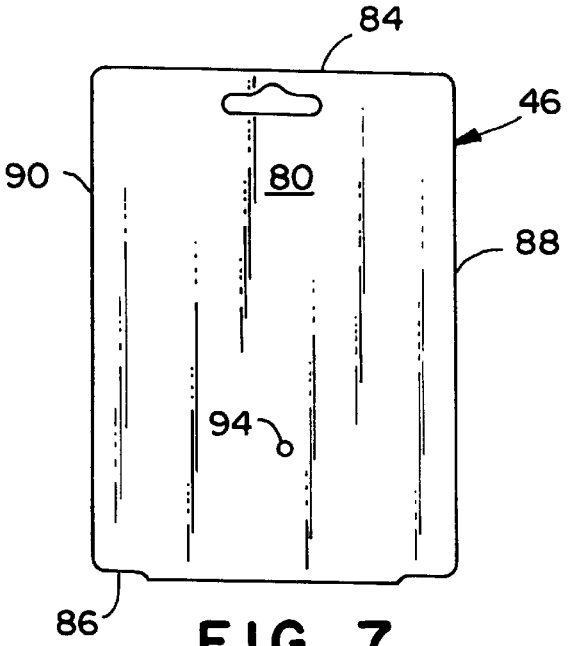
FIG. 7 is a top plan view of the rear display card.

The phone card package 40 is constructed using generally conventional techniques and apparatus, such as conventional die cutting machinery. Referring now to FIG. 4, the front display card 44 is a generally rectangular, planar sheet of paperboard which includes a front major surface 60, a rear major surface 62, a top edge 64, a bottom edge 66, and opposed side edges 68 and 70. The front display card 44 defines a generally rectangular blister window 72 and a locating pin notch 74, or pin opening, adapted to fit over the interior locating pin 16. In some applications, it may be desirable for the interior locating pin 16 to be spaced apart from the blister window 72. In such cases, the notch 74 can be replaced by a circular aperture or other opening (not shown) defined at the desired location in the front display card 44. The rear display card 46 is generally identical to the front display card 44, and includes a front major surface 80, a rear major surface 82, a top edge 84, a bottom edge 86, opposed side edges 88 and 90, and a circular locating pin aperture 94, or pin opening (See FIG. 7). The rear display card 46 does not, however, define a blister window. The shape and size of the display cards can vary from application to application. For example, the front and rear display cards can be different in shape and/or size from each other. Also, the front and rear display cards can be embossed in the shape of the phone card 48 and/or the blister 42 to help locate them in the package. Further, the blister 42 can be eliminated altogether and the pins 16, 14*g–h* and 18*a–b* can be used to locate the phone card 48 with respect to the display card(s).

The front 44 and rear 46 display cards are typically die cut from paperboard or other conventional stock materials. The rear major surface 62 of the front display card 44 and the front major surface 80 of the rear display card 46 are coated with a layer of heat activated adhesive which will eventually intersecure the blister 42 and display cards 44 and 46 as described below. Also, graphics, product information, and other printed material can be printed on the front major surface 60 of the front display card 44 and the rear major surface 82 of the rear display card 46

Figure 5:
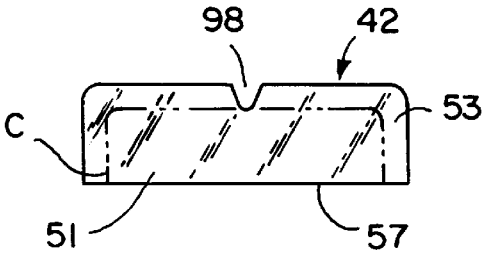
FIG. 5 is a top plan view of the blister.

Referring now to FIG. 5, the blister 42 is generally rectangular and is manufactured from a transparent or translucent plastic stock, preferably using conventional die cutting apparatus. The blister 42 is preferably planar and includes a central portion 51 adapted to engage the phone card 48 and a peripheral marginal portion 53 adapted to be secured to one or more of the display cards 44 and 46. In FIG. 5, the central portion 51 and the peripheral marginal portion 53 are separated by phantom line C. The peripheral marginal portion 53 defines a locating pin notch 98 adapted to fit over the interior locating pin 16. The notch 98 is tapered to shepherd a slightly askewed blister 42 into proper alignment as it is placed onto the jig 10. Obviously, the notch 98 could be replaced by a hole or other aperture. The notch 98 is positioned so that the interior locating pin 16 will engage the edge of the phone card 48 when it is placed in the blister 42. This permits the interior locating pin 16 to locate both the blister 42 and the phone card 48.

Figure 14:
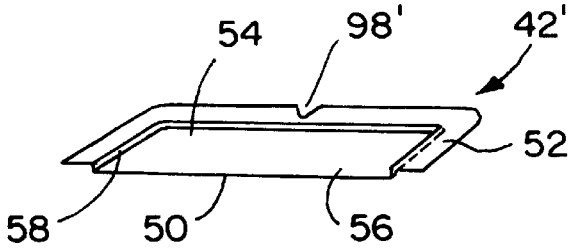
FIG. 14 is a perspective view of an alternative blister.

As shown in FIG. 14, the blister 42' can alternatively include a pocket 50 and an offset flange 52. The pocket 50 includes a generally planar face 56 and a wall 58 extending along three sides of the face 56. The face 56 and wall 58 cooperate to define a generally rectangular void 54. The dimensions of the pocket 50 closely correspond with the dimensions of the phone card 48 so that, once the package is assembled, the phone card is held firmly between the blister 42 and the rear display panel 46. The flange 52 extends outwardly from the wall 58 along three sides of the blister 42. The flange 52 defines a locating pin notch 98' adapted to fit over the interior locating pin 16. The notch 98' can be replaced by a hole or other aperture. This alternative blister 42' is preferably manufactured using conventional vacuum forming techniques and apparatus.

In another alternative embodiment (not shown), the blister can include a pocket that is shaped to locate the article during assembly of the package. In this embodiment, the interior locating pin is not needed to locate the article, and therefore the notch can be eliminated and the interior locating pin can be positioned to simply engage the outer edge of the blister.

Figure 8:
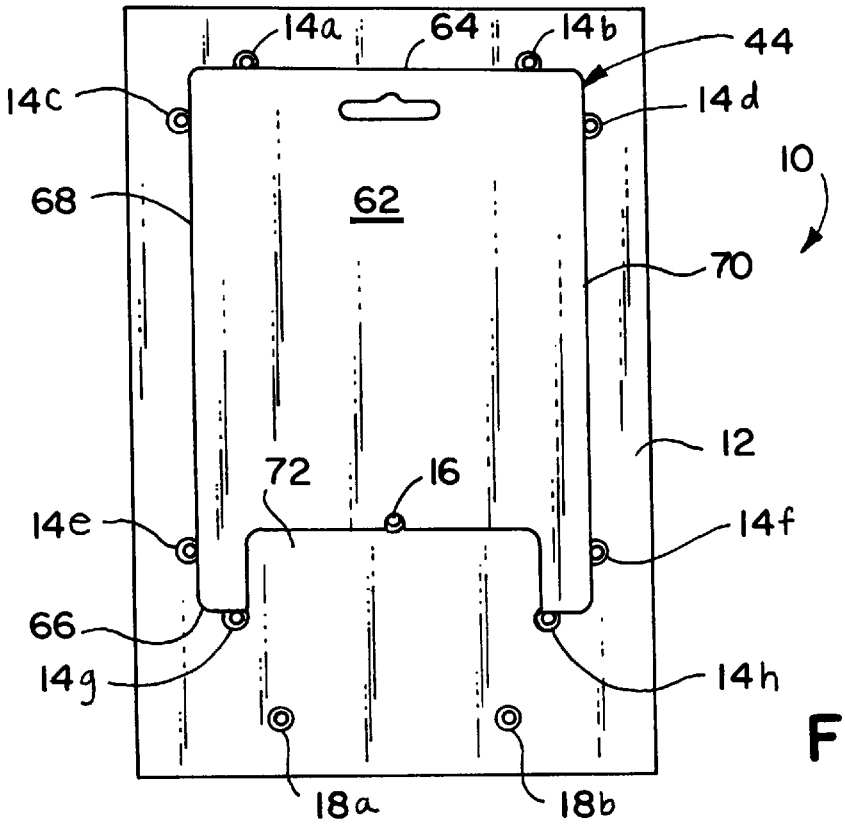
FIG. 8 is a top plan view of the jig showing the front display card in position on the jig.

The various components of the package 40 and the phone card 48 are preferably positioned on the jig 10 using conventional automated machinery, such as a conventional card feeder. The design, layout, and operation of this machinery is well within the purview of one of ordinary skill in the art. As best illustrated in FIG. 8, the phone card package 40 is assembled by first positioning the front display card 44 onto the jig 10 face down with its top edge 64 abutting the perimeter locating pins 14*a* and 14*b*, its bottom edge 66 abutting the perimeter locating pins 14*g* and 14*h*, and its opposed side edges 68 and 70 abutting the perimeter locating pins 14*c–f*. Additionally, the interior locating pin notch 74 is fitted over the interior locating pin 16. If desired, the front display card 44 can be eliminated and the blister 42 can be secured solely to the front major surface 80 of the rear display card 46.

Figure 9:
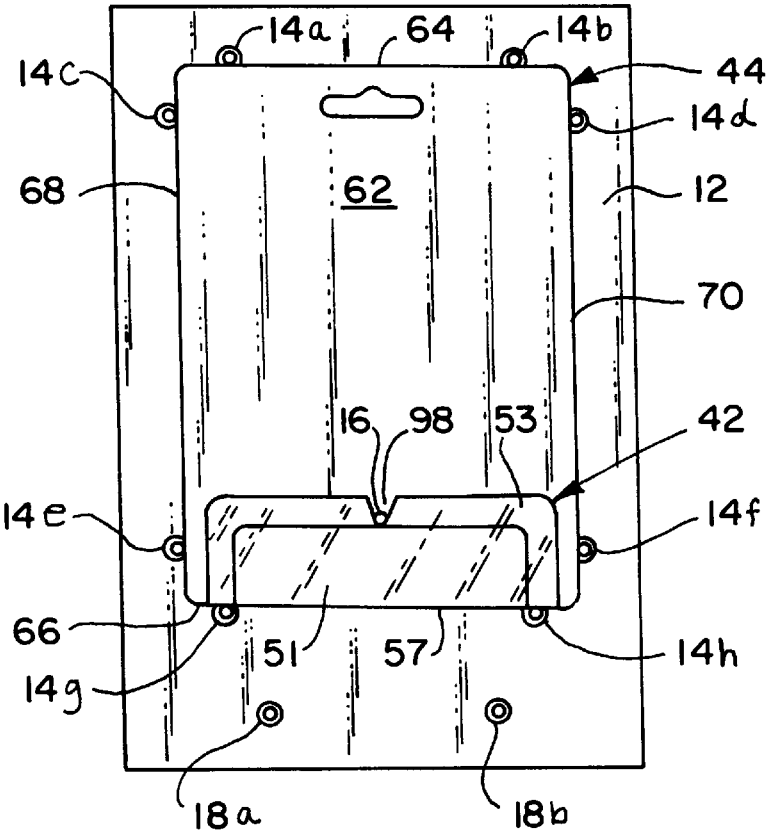
FIG. 9 is a top plan view of the jig showing the front display card and blister in position on the jig.

Next, the blister 42 is positioned onto the jig 10 over the front display card 44. The central portion 51 is aligned with the blister window 72 of the front display card 44 (See FIG. 9). As a result, the blister 42 is supported by the peripheral marginal portion 53 which engages the rear major surface 62 of the front display card 44 immediately above the platen 12. The bottom edge 57 of the blister 42 engages the perimeter locating pins 14*g* and 14*h* and the notch 98 is fitted over the interior locating pin 16. Alternatively, the blister 42 can be preattached to the front display card 44 using conventional techniques and apparatus.

Figure 10:
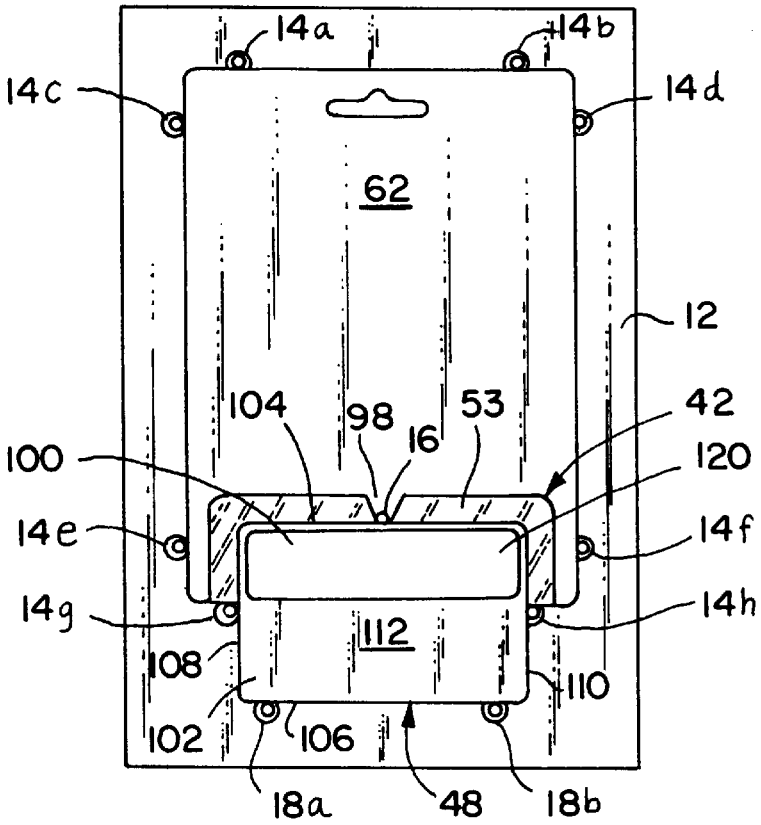
FIG. 10 is a top plan view of the jig showing the front display card, blister, and phone card in position on the jig.
Figure 11:
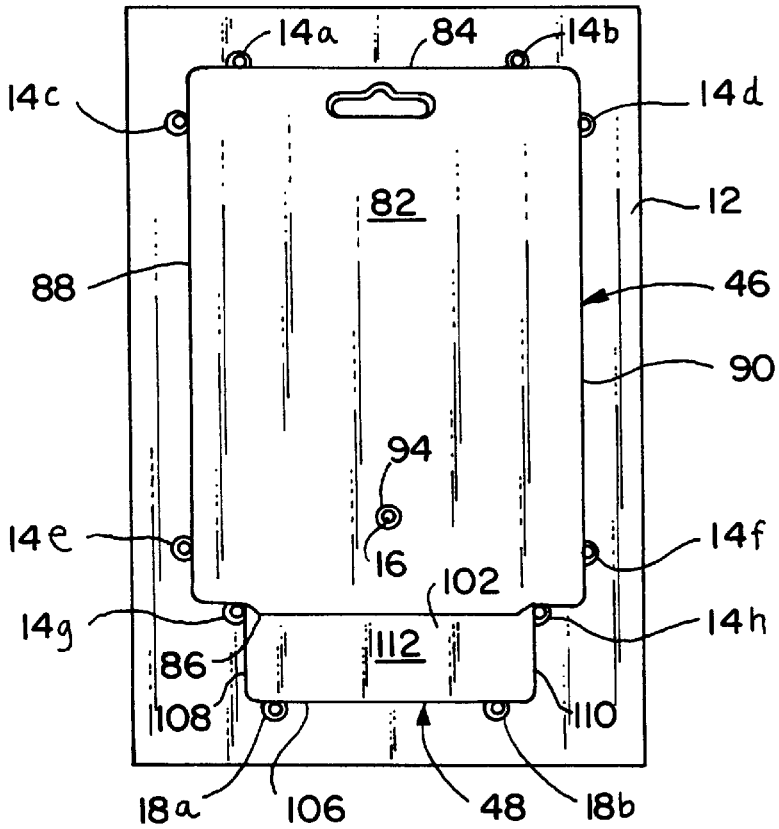
FIG. 11 is a top plan view of the jig showing the front display card, blister, phone card, and rear display card in position on the jig.

After the blister 42, the phone card 48 is positioned onto the jig 10 as shown in FIG. 10. The phone card 48 is positioned such that its upper half 100 is coextensive with the central portion 51 of the blister 42 and its lower half 102 extends outwardly from the package 40. As previously noted, the edge of the phone card 48 can alternatively be flush with or even slightly inwardly offset from the edge of the package. The top edge 104 of the phone card abuts the interior locating pin 16, the bottom edge 106 of the phone card 48 abuts the exterior locating pins 18*a* and 18*b*, and the opposed side edges 108 and 110 of the phone card 48 abut the perimeter locating pins 14*g* and 14*h*, respectively. Once the phone card 48 is positioned on the jig 10, a layer of peelable adhesive 120 is applied to the rear major surface 112 of the phone card 48. The peelable adhesive 120 is applied to an upper portion of the phone card 48 where it will contact the front major surface 80 of the rear display card 46 to secure the phone card 48 firmly to the package 40. Alternatively, the peelable adhesive can be applied to the front major surface 80 of the rear display card 46 adjacent the bottom edge 86. The peelable adhesive is preferably a hot melt glue, and is applied using a conventional automated glue applicator. A suitable hot melt is available from L&D Adhesives of Comstock Park, Mich., under the trade name INSTANT-LOK.

Next, the rear display card 46 is positioned onto the jig 10 face down with its top edge 84 abutting the perimeter locating pins 14*a* and 14*b*, its bottom edge 86 abutting the perimeter locating pins 14*g* and 14*h*, and its opposed side edges 88 and 90 abutting the perimeter locating pins 14*c–f*. Also, the interior locating pin aperture 94 is fitted over the interior locating pin 16.

After all of the components are positioned onto the jig 10, a conventional heat press (not shown) is lowered onto the jig 10 to simultaneously apply heat and pressure to the package 40. The face of the heat press is relieved in the appropriate location to allow for the thickness of the phone card 48 and the thickness of the blister 42. In some applications, the blister 42 may be thin enough that its thickness need not be taken into consideration when relieving the face of the heat press. If the locating pins are solid, the press is also relieved to define a plurality of bores that surround and receive the pins when the press is lowered. Alternatively, if the pins are spring-loaded, they are increasingly pushed into the face of the jig as the press increasingly approaches and compresses the package. The heat from the press activates the heat activated adhesive (not shown) coated on the display cards 44 and 46, and may also reactivate the peelable adhesive 120. The pressure generated by the press forces the various components together to bond the display cards 44 and 46 and the blister 42 together along mating surfaces. In addition, the pressure compresses the phone card 48 and rear display card 46 together so that the peelable adhesive 120 firmly secures the phone card 48 to the rear display card 46. The peelable adhesive 120 provides sufficient shear strength to prevent the phone card 48 from being pulled out of the bottom of the package 40. However, the phone card 48 is easily peeled up from the rear display card 46 when the package 40 is opened.

Alternative Embodiment

Figure 13:
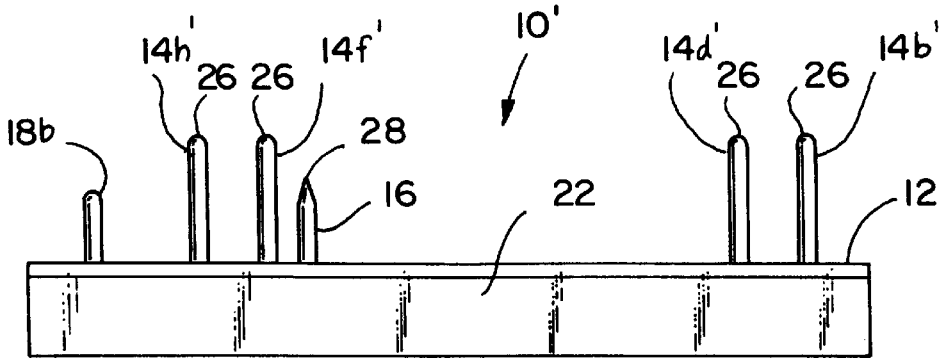
FIG. 13 is a side elevational view of an alternative jig.

In an alternative embodiment, the interior locating pin aperture 94 is eliminated from the rear display card and the pin 16 is a conventional spring-loaded pin that retracts into the jig 10' as the press (not shown) is lowered onto the package. In this alternative construction, the perimeter locating pins 14*a–h*' are sufficiently longer than the interior locating pin 16 so that the rear display card 46 is held in place even when resting upon the extended interior locating pin 16 (See FIG. 13). As the press in lowered, the rear display card 46 is forced down toward the surface 22 of the jig 10' causing the interior locating pin 16 to retract into the jig 10'. When the press is fully lowered, the interior locating pin 16 is fully retracted and the various components of the package are pressed together and intersecured as in the preferred embodiment. This alternative construction permits the manufacture of a package with a hole in only the front display card 44. As a result, it may be preferred when it is not desirable for a hole to extend entirely through the package.

Further, this alternative structure can also be used to provide a package in which only the rear display card 46 includes a hole. Here, the components are assembled on the jig 10' in reverse. First, the rear display card 46 with a locating pin aperture 94 is placed on the jig 10'. Second, the article 48 is placed on the jig 10' in proper alignment with the rear display card 46. Third, the blister 42 is placed on the jig 10' over the article 48 and the rear display card 46. If necessary, the press, work surface 22, and/or platen 12 is relieved to define a void (not shown) that surrounds and receives the blister 42 and the phone card 48 when the press is lowered. And finally, the front display card 44 (without locating pin notch 74) is placed on the jig 10' over the other components. Because the perimeter locating pins 14*a–h*' are longer than the interior locating pin 16, they will function to align the front display card 44 even when the front display card 44 rests atop the extended interior locating pin 16. As the press (not shown) is lowered onto the jig 10', the front display card 44 is forced down toward the surface 22 of the jig 10', in turn pushing the spring-loaded interior locating pin 16 into the jig 10'. Once the press is completely lowered, the pin 16 is completely retracted into the jig 10' and the various components of the package are pressed together and intersecured as in the preferred embodiment.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A packaging jig for packaging an article in a package having a display card and a blister wherein the display card includes an outer edge and defines a pin opening comprising:

a work surface adapted to support the display card during assembly of the package;

an interior locating pin mounted within said surface, said interior locating pin positioned to pass through the pin opening in the display card and directly engage the blister during assembly of the package, whereby said interior locating pin locates the blister with respect to the display card during assembly.

2. The packaging jig of claim 1 wherein said jig further includes a plurality of perimeter locating pins mounted within said surface, said perimeter locating pins arranged to align with and engage the outer edge of the package during assembly of the package.

3. A packaging jig for packaging an article in a package having a display card and a blister wherein the display card includes an outer edge and defines a pin opening comprising:

a work surface adapted to support the display card during assembly of the package;

an interior locating pin mounted within said surface, said interior locating pin positioned to pass through the pin opening in the display card and locate the blister during assembly of the package;

a plurality of perimeter locating pins mounted within said surface, said perimeter locating pins arranged to align with and engage the outer edge of the package during assembly of the package; and an exterior locating pin positioned outside of said perimeter locating pins to engage the article during assembly of the package.

4. The packaging jig of claim 3 wherein the blister includes an outer edge aligned with the outer edge of the display, at least one of said perimeter locating pins positioned to simultaneously align with and engage the outer edge of the blister, the outer edge of the display card, and the article during assembly of the package.

5. The packaging jig of claim 4 wherein said interior locating pin is positioned to simultaneously align with and engage the blister and the article during assembly of the package.

6. The packaging jig of claim 5 wherein the blister includes a flange defining a pin opening, said interior locating pin positioned to extend through the pin opening in the flange during assembly of the package.

7. The packaging jig of claim 6 wherein said interior locating pin includes a tapered tip.

8. The packaging jig of claim 7 wherein said exterior locating pin and said interior locating pin are positioned to align with and engage opposed sides of the article during assembly of the package.

9. A packaging jig and package assembly comprising:

a work surface;

a package located on said surface, said package including a display card and a blister, said display card having an outer edge and defining a pin opening; and an interior locating pin mounted within said surface, said interior locating pin extending through said pin opening of said display card and directly engaging said blister to register said blister in relation to said display card.

10. A packaging jig and package assembly comprising:

a work surface;

a package located on said surface, said package including a display card and a blister, said display card having an outer edge and defining a pin opening;

an interior locating pin mounted within said surface, said interior locating pin extending through said pin opening of said display card and engaging said blister to register said blister in relation to said display card;

an article disposed partially within said blister; and an exterior locating pin mounted within said surface, said exterior locating pin positioned outside of said display card and engaging said article.

11. The assembly of claim 10 further comprising a plurality of perimeter locating pins mounted within said surface, said perimeter locating pins arranged around and engaging said outer edge of said display card.

12. The assembly of claim 11 wherein said blister includes an outer edge aligned with said outer edge of said display card, at least one of said perimeter locating pins aligned with and engaging said outer edge of said blister, said outer edge of said display card, and said article.

13. The assembly of claim 12 wherein said interior locating pin is aligned with and engages said blister and said article.

14. The assembly of claim 13 wherein said blister includes a flange defining a pin opening, said interior locating pin extending through said pin opening.

15. The assembly of claim 14 wherein said interior locating pin includes a tapered tip.

16. The assembly of claim 15 wherein said exterior locating pin and said interior locating pin align with and engage opposed sides of said article.

17. A method for packaging an article comprising the steps of:

providing a jig having an interior locating pin;

positioning a blister on the jig in direct engagement with the locating pin;

positioning an article on the jig at least partially within the blister, the article abutting the interior locating pin;

positioning a rear display card on the jig, the rear display card defining a pin opening fitted over the interior locating pin; and intersecuring the rear display card and the blister.

18. The method of claim 17 wherein the jig further includes an exterior locating pin, said article positioning step further including positioning the article with the article abutting the exterior locating pin.

19. The method of claim 18 further comprising the step of positioning a front display card on the jig prior to said blister positioning step, the front display card defining a pin opening fitted over the interior locating pin.

20. The method of claim 19 wherein the front display card defines a blister window and the blister includes a central portion, said blister positioning step further including positioning the blister on the jig with the central portion aligned with the blister window.

21. The method of claim 20 wherein said intersecuring step includes intersecuring the blister and the front and rear display cards by a heat activated adhesive.

22. The method of claim 21 wherein said intersecuring step further includes intersecuring the article and at least one display card by a peelable adhesive.

23. The method of claim 22 wherein said blister positioning step further includes positioning the blister with the blister abutting at least one perimeter locating pin.

24. The method of claim 23 wherein the jig further includes a plurality of perimeter locating pins, said article positioning step further includes positioning the article with the article abutting at least one perimeter locating pin.

25. A packaging jig and package assembly comprising:

a work surface;

a display card located on said surface, said display card having an outer edge;

an article located on said surface partially overlapping with said display card;

a plurality of perimeter locating pins mounted within said surface, said perimeter locating pins arranged around and engaging said outer edge of said display card; and an exterior locating pin mounted within said surface, said exterior locating pin spaced outwardly from said outer edge of said display card and engaging said article to register said article in relation to said display card.

26. The assembly of claim 25 further comprising a blister located on said jig, said article located between and partially overlapping with said blister and said display card.

27. The assembly of claim 26 further including at least two exterior locating pins engaging said article, said exterior locating pins spaced apart from each other to prevent said article from twisting.

28. A packaging jig and package assembly comprising:

a work surface;

a package located on said surface, said package defining a pin opening;

an article positioned within said package on said surface; and an interior locating pin mounted within said surface, said interior locating pin extending through said pin opening of said package and engaging said article to register said article in relation to said display card.

29. The assembly of claim 28 further comprising an exterior locating pin mounted within said surface, said exterior locating pin positioned outside of said package and engaging said article.

* * * * *